US007070892B2

(12) United States Patent
Bender et al.

(10) Patent No.: US 7,070,892 B2
(45) **Date of Patent: *Jul. 4, 2006**

(54) IMAGING MEMBERS

(75) Inventors: Timothy P. Bender, Port Credit (CA); John F. Graham, Oakville (CA); James M. Duff, Mississauga (CA); Andronique Ioannidis, Webster, NY (US); Nancy L. Belknap, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 187 days.

This patent is subject to a terminal disclaimer.

(21) Appl. No.: 10/765,355

(22) Filed: Jan. 27, 2004

(65) Prior Publication Data

US 2005/0164106 A1 Jul. 28, 2005

(51) Int. Cl.
*G03G 5/047* (2006.01)
*G03G 5/06* (2006.01)

(52) U.S. Cl. ..... 430/58.25; 430/72

(58) Field of Classification Search ..... 430/58.25, 430/72

See application file for complete search history.

(56) References Cited

U.S. PATENT DOCUMENTS

| | | | | |
|---|---|---|---|---|
| 4,265,990 | A | 5/1981 | Stolka et al. | 430/59 |
| 4,474,865 | A | 10/1984 | Ong et al. | 430/58 |
| 4,546,059 | A | 10/1985 | Ong et al. | 430/59 |
| 4,559,287 | A | 12/1985 | McAneney et al. | 430/59 |
| 4,562,132 | A | 12/1985 | Ong et al. | 430/59 |
| 4,587,189 | A | 5/1986 | Hor et al. | 430/59 |
| 5,336,577 | A | 8/1994 | Spiewak et al. | 460/59 |
| 5,473,064 | A | 12/1995 | May et al. | 540/141 |
| 5,493,016 | A | 2/1996 | Burt et al. | 540/139 |
| 6,656,650 | B1 * | 12/2003 | Lin et al. | 430/56 |
| 6,858,363 | B1 * | 2/2005 | Belknap et al. | 430/65 |
| 2004/0038140 | A1 | 2/2004 | Duff et al. | |
| 2004/0142257 | A1 * | 7/2004 | Ioannidis | 430/56 |
| 2004/0197685 | A1 * | 10/2004 | Ioannidis et al. | 430/56 |

OTHER PUBLICATIONS

Liang-Bih Lin et al., U.S. Appl. No. 10/144,147, filed May 10, 2002 on Imaging Members.

* cited by examiner

*Primary Examiner*—John L Goodrow
(74) *Attorney, Agent, or Firm*—E. O. Palazzo

(57) ABSTRACT

A photoconductive imaging member containing a supporting substrate, and thereover a single layer comprised of a photogenerator component, a charge transport component, an electron transport component, and a polymer binder.

34 Claims, No Drawings

IMAGING MEMBERS

RELATED PATENT APPLICATIONS AND PATENTS

Illustrated in copending application U.S. Ser. No. 10/144,147, filed May 10, 2002, Publication No. 20030211413, now abandoned, the disclosure of which is totally incorporated herein by reference, is, for example, a photoconductive imaging member comprised of a supporting substrate, and thereover a single layer comprised of a mixture of a photogenerator component, a charge transport component, an electron transport component, and a polymer binder, and wherein the photogenerating component is a metal free phthalocyanine.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a perylene photogenerating layer, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by the reaction of gallium chloride in a solvent, such as N-methylpyrrolidone, present in an amount of from about 10 parts to about 100 parts, and preferably about 19 parts with 1,3-diiminoisoindolene in an amount of from about 1 part to about 10 parts, and preferably about 4 parts of DI3, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, such as for example, the supporting substrates, the photogenerating pigments, the charge transport components, resin binders, hole blocking layers, adhesive layers, and the like, and processes of the above copending applications and patents may be selected for the invention of the present application in embodiments thereof.

BACKGROUND

This invention relates in general to electrophotographic imaging members and, more specifically, to positively and negatively charged electrophotographic imaging members containing multilayers, or a single layer and processes for forming images on the member. More specifically, the present invention relates to a single layered photoconductive imaging member containing a charge generation layer or photogenerating layer comprised of a photogenerating pigment component dispersed in a matrix of a hole transporting component and electron transporting components, and in embodiments which members further contain a hole blocking layer, an adhesive layer, and a protective layer with respect to multilayered devices. The electrophotographic imaging member layer components, which can be dispersed in various suitable resin binders, can be of a number of suitable thickness, however, in embodiments a thick layer, such as from about 5 to about 60, and more specifically, from about 10 to about 40 microns, is selected. This layer can be considered a dual functional layer since it can generate charge and transport charge over a wide distance, such as a distance of at least about 50 microns. Also, the presence of the electron transport components in the photogenerating layer can enhance electron mobility and thus enable a thicker photogenerating layer, and which thick layers of, for example, from about 10 to about 40 microns can be more easily coated than a thin layer, such as about 1 to about 2 microns in thickness. Moreover, in embodiments the multilayered photoconductive devices of the present invention are comprised of a supporting substrate, a photogenerating layer, an electron transport layer and a charge, especially hole transport layer.

REFERENCES

A number of multilayered imaging members are known, and which members can be comprised, for example, of a substrate, a charge generating layer and a charge transport layer. These multilayered imaging members can also contain a charge blocking layer and an adhesive layer between the substrate and the charge generating layer. Further, an anti-plywooding layer may be included in the aforementioned members. This anti-plywooding layer can be a separate layer or be part of a dual function layer. An example of a dual function layer for preventing plywooding is a charge blocking layer or an adhesive layer which also prevents plywooding. The expression "plywooding" refers, for example, to the formation of unwanted patterns in electrostatic latent images caused by multiple reflections during laser exposure of a charged imaging member. When developed, these patterns resemble plywood. The aforementioned multilayered imaging members are also costly and time consuming to fabricate because of the many layers that must be formed. Further, complex equipment and valuable factory floor space are required to manufacture these multilayered imaging members. In addition to presenting plywooding problems, the multilayered imaging members often encounter charge spreading which degrades image resolution.

Another problem encountered with multilayered photoreceptors comprising a separate charge generating layer and a separate charge transport layer is that the thickness of the charge transport layer, which is normally the outermost layer, tends to become thinner due to wear during image cycling. The change in thickness can cause changes in the photoelectrical properties of the photoreceptor. Thus, to maintain image quality, complex and sophisticated electronic equipment and software management are usually necessary in the imaging machine to compensate for the photoelectrical changes, which can increase the complexity of the machine, cost of the machine, size of the footprint occupied by the machine, and the like. Without proper compensation of the changing electrical properties of the photoreceptor during cycling, the quality of the images formed can degrade because of spreading of the charge pattern on the surface of the imaging member and a decline in image resolution. High quality images can be important for digital copiers, duplicators, printers, and facsimile machines, particularly laser exposure machines that demand high resolution images. Moreover, the use of lasers to expose conventional multilayered photoreceptors can lead to the formation of undesirable plywood patterns that are visible in the final images.

The fabrication of electrophotographic imaging members comprising a substrate and a single electrophotographic photoconductive insulating layer in place of a plurality of layers, such as a charge generating layer and a charge transport layer, is know. However, in formulating single electrophotographic photoconductive insulating layer photoreceptors there are several problems to substantially eliminate including charge acceptance for hole and/or electron transporting materials from photoelectroactive pigments. In addition to electrical compatibility and performance, a material mix for forming a single layer photoreceptor should possess the proper rheology and resistance to agglomeration to enable acceptable coatings. Also, compatibility among photogenerating pigment, hole and electron transport molecules, and film forming binder is desirable. As utilized herein, the expression "single electrophotographic photoconductive insulating layer" refers in embodiments to a single electrophotographically active photogenerating layer capable of retaining an electrostatic charge in the dark during electrostatic charging, imagewise exposure and image development. Thus, unlike a single electrophotographic photoconductive insulating layer photoreceptor, a multilayered photoreceptor has at least two electrophotographically active layers, namely at least one charge generating layer and at least one separate charge transport layer.

The above and other disadvantages are avoided or minimized with the single and multilayer photoconductive imaging members of the present invention.

U.S. Pat. No. 4,265,990 discloses a photosensitive member having at least two electrically operative layers. The first layer comprises a photoconductive layer which is capable of photogenerating holes and injecting photogenerated holes into a contiguous charge transport layer. The charge transport layer contains hole transport molecules and, for example, a polycarbonate resin containing from about 25 to about 75 percent by weight of one or more of a compound having a specified general formula. This structure may be imaged in the conventional xerographic mode which usually includes charging, exposure to light and development.

U.S. Pat. No. 5,336,577 discloses a thick organic ambipolar layer on a photoresponsive device is simultaneously capable of charge generation and charge transport. In particular, the organic photoresponsive layer contains an electron transport material such as a fluorenylidene malonitrile derivative and a hole transport material such as a dihydroxy tetraphenyl benzadine containing polymer. These may be complexed to provide photoresponsivity, and/or a photoresponsive pigment or dye may also be included.

Photoconductive imaging members with electron transport layers, such as carboxyfluorenone malononitriles (CFMs) like the butyl derivative of CFM, that is (4-n-butoxycarbonyl-9-fluorenylidene)malononitrile (BCFM), are illustrated, for example, in U.S. Pat. Nos. 4,474,865; 4,546,059; 4,559,287, and 4,562,132. One known electron transport is a carboxyfluorenone malononitrile (CFM) of the formula illustrated hereinafter, wherein photoreceptor members containing these electron transports may not have sufficient solubility in organic solvents, such as butylacetate, tetrahydrofuran, toluene and the like; and/or sufficient solid state compatibility with organic polymeric binder materials, such as polyesters, polycarbonates, polystyrene, and the like;

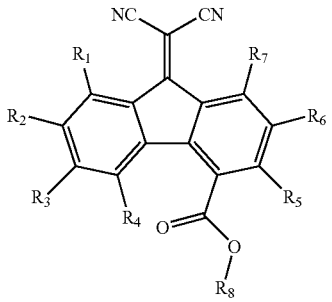

wherein each R is independently selected from, for example, the group consisting of hydrogen, alkyl, alkoxy, aryl, halide, and substituted aryl.

The entire disclosures of each of the above patents are totally incorporated herein by reference.

SUMMARY

It is therefore, a feature of the present invention to provide electrophotographic imaging members comprising a single electrophotographic photoconductive insulating layer.

It is another feature of the present invention to provide an electrophotographic imaging member comprised of a single electrophotographic photoconductive insulating layer that avoids or minimizes plywooding problems, and which single layer contains a photogenerating pigment, an electron transport component, a hole transport component, and a filming forming binder, and further wherein the electron transport is compatible with the film forming binder and is substantially soluble in organic solvents, such as ethers, aromatic hydrocarbons, acetates, alcohols and the like, and wherein the solubility thereof is, for example, from about 1 to about 250 grams/liter, more specifically from about 150 to about 250 grams/liter, and yet more specifically from about 200 to about 250 grams/liter.

It is still another feature of the present invention to provide an improved electrophotographic imaging member comprising a single electrophotographic photoconductive insulating layer that eliminates the need for a charge blocking layer between a supporting substrate and an electrophotographic photoconductive insulating layer, and wherein the photogenerating mixture layer can be of a thickness of, for example, from about 5 to about 60 microns, and thereover as the top layer a charge transporting layer, and which members possess excellent high photosensitivities, acceptable discharge characteristics, and further which members are visible and infrared laser compatible.

It is yet another feature of the present invention to provide an electrophotographic imaging member comprising a single electrophotographic photoconductive insulating layer which can be fabricated with fewer coating steps at reduced cost.

It is another feature of the present invention to provide an electrophotographic imaging member comprising a single electrophotographic photoconductive insulating layer which eliminates charge spreading, therefore, enabling higher resolution, and which members are not substantially susceptible to plywooding effects, a light refraction problem, and thus with the photoconductive imaging members of the present invention in embodiments thereof an undercoated separate layer can be avoided.

It is yet another feature of the present invention to provide an improved electrophotographic imaging member comprising a single electrophotographic photoconductive insulating layer, which has improved cycling and stability, and which members possess high resolution since, for example, the image forming charge packet does not need to traverse the entire thickness of the member and thus does not spread in area, and further with such single layered members there is enabled in embodiments extended life high resolution members since, for example, the layer can be present in a thicker, such as from 5 to about 60 microns, layer as compared to a number of multilayered devices wherein the thickness of the photogenerator layer is usually about 1 to about 3 microns in thickness, thus with the aforementioned invention devices there is substantially no image resolution loss and substantially no image resolution loss with wear.

It is yet another feature of the present invention to provide an improved electrophotographic imaging member comprising a single electrophotographic photoconductive insulating layer for which PIDC curves do not substantially change with time or repeated use, and also wherein with these photoreceptors charge injections from the substrate to the photogenerating pigment is reduced and thus a charge blocking layer can be avoided.

It is still another feature of the present invention to provide an improved electrophotographic imaging member comprising a single electrophotographic photoconductive insulating layer which is ambipolar and can be operated at either positive (the preferred mode) or negative biases.

The present invention in embodiments thereof is directed to a photoconductive imaging member comprised of a supporting substrate, a single layer thereover comprised of a mixture of a photogenerating pigment or pigments, a hole transport component or components, an electron transport component or components, and a film forming binder. More specifically, the present invention relates to an imaging member with a thick, such as for example, from about 5 to about 60 microns, single active layer comprised of a mixture of photogenerating pigments, hole transport molecules, electron transport compounds, and a filming binder, and wherein the electron transport components are comprised, for example, of the 2-ethylhexanol derivatives of BCFM.

Aspects of the present invention in embodiments thereof are directed to a photoconductive imaging member comprised of a supporting substrate, and thereover a single layer comprised of a mixture of a photogenerator component, a charge transport component, an electron transport component, and a polymer binder, and wherein the electron component is comprised of

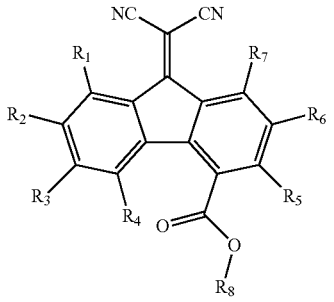

wherein $R_1$ to $R_7$ are independently selected from the group consisting of hydrogen, halide, alkyl, alkoxy, and aryl, and wherein $R_8$ is an alkyl alkyl; a photoconductive imaging member comprised of a supporting substrate, and thereover a single layer comprised of a mixture of an optional photogenerator component, a charge transport component, an electron transport component, and a binder, and wherein the electron component is comprised of an alkylalcohol derivative of the formula

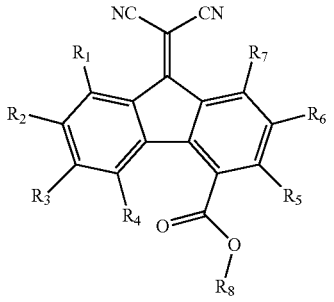

wherein $R_1$ to $R_7$ are independently selected from the group consisting of hydrogen, halide, alkyl, alkoxy, and aryl, and wherein $R_8$ is an alkyl alkyl, or other suitable substituent; a photoconductive imaging member comprised of a photogenerating layer, an electron transport layer and a charge transport layer, and wherein the electron component is of the formula

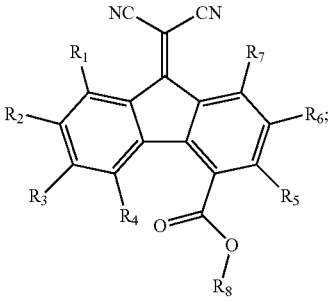

an imaging member containing an electron transport of the formula

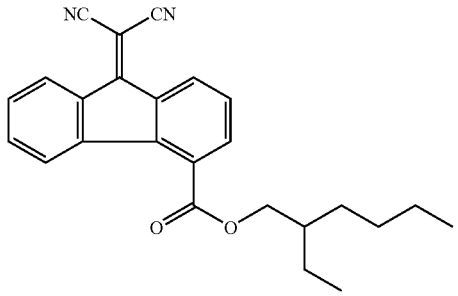

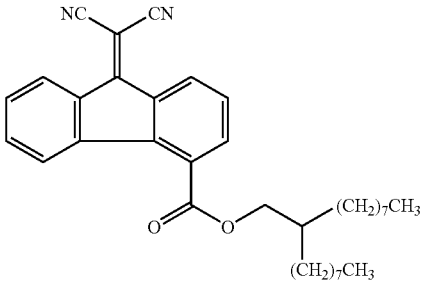

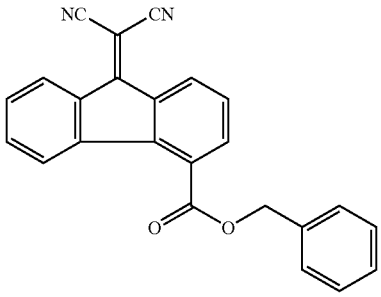

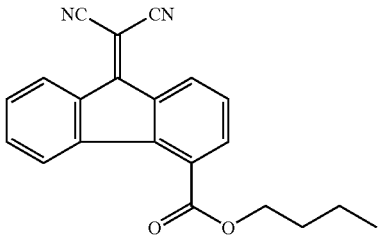

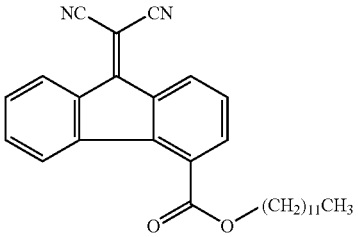

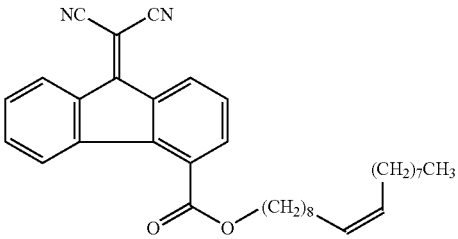

-continued

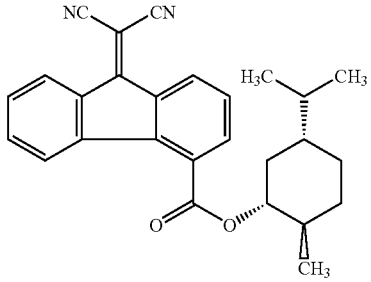

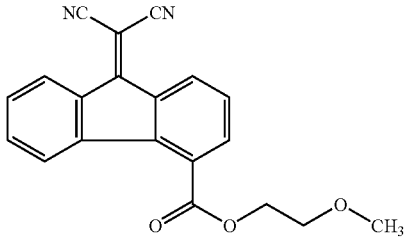

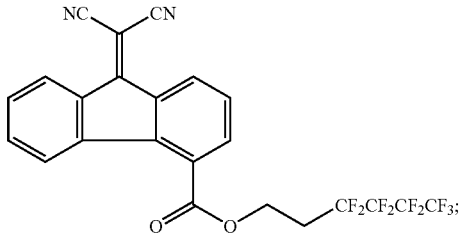

a photoconductive imaging member comprised of a supporting substrate, and thereover a layer comprised of a photogenerator pigment, a hole transport component, and as an electron transport component 9-dicyanomethylenefluorene-4-(2-ethylhexyl)carboxylate or 4-(2-ethyl-1-hexoxycarbonyl-9-fluorenylidene) malononitrile (2EHCFM), that is the 2-ethylhexanol derivative of CFM; a member wherein the single layer is of a thickness of from about 10 to about 50 microns; a member wherein the amounts for each of the components in the single layer mixture are from about 0.05 weight percent to about 30 weight percent for the photogenerating component, from about 10 weight percent to about 75 weight percent for the hole transport component, and from about 15 weight percent to about 70 weight percent for the electron transport component, and wherein the total of the components is about 100 percent, and wherein the layer is dispersed in from about 10 weight percent to about 75 weight percent of a polymer binder; a member wherein the amounts for each of the components is from about 0.5 weight percent to about 5 weight percent for the photogenerating component, from about 30 weight percent to about 50 weight percent for the charge transport component, and from about 5 weight percent to about 30 weight percent for the electron transport component; and which components are contained in from about 30 weight percent to about 50 weight percent of a polymer binder; a member wherein the thickness of the single photogenerating layer mixture is from about 10 to about 40 microns; a member wherein the components are contained in a polymer binder, and wherein the charge transport is comprised of hole transport molecules; a member wherein the binder is present in an amount of from about 40 to about 90 percent by weight, and wherein the total of all components of photogenerating component, the hole transport component, the binder, and the electron transport component is about 100 percent; a member wherein the photogenerating pigment, such as a metal free phthalocyanine, absorbs light of a wavelength of from about 550 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein a component of the single mixture layer is selected from the group consisting of polyesters, polyvinyl butyrals, polycarbonates, polystyrene-b-polyvinyl pyridine, amines, such as N,N'-diphenyl-N,N'-bis(alkylphenyl)-1,1-biphenyl-4,4'-diamine; tri-p-tolylamine; N,N'-bis-(3,4,-dimethylphenyl)-4-biphenyl amine; N,N'-bis-(4-methylphenyl)-N,N"-bis(4-ethylphenyl)-1,1'-3,3'-dimethylbiphenyl)-4,4'-diamine; PHN, phenanthrene diamine; polyvinyl formulas; and the like; an imaging member wherein the hole transport in the photogenerating mixture comprises aryl amine molecules; an imaging member wherein the hole transport in the photogenerating mixture is comprised of

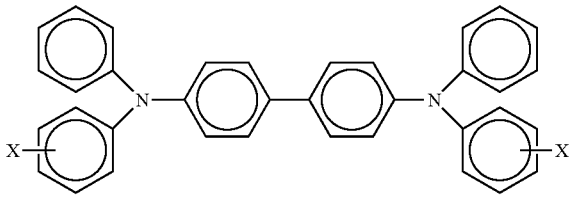

wherein X is selected from the group consisting of alkyl and halogen; an imaging member wherein alkyl contains from about 1 to about 10 carbon atoms, and which amine is optionally dispersed in a highly insulating and transparent resinous binder; an imaging member wherein alkyl contains from 1 to about 5 carbon atoms; an imaging member wherein alkyl is methyl, and wherein halogen is chloride; an imaging member wherein the charge transport is comprised of N,N'-diphenyl-N,N-bis(3-methyl phenyl)-1,1'-biphenyl-4,4'-diamine dispersed in a resin binder; an imaging member wherein the electron transport component is the 2-ethylhexanol analog of (4-n-butoxycarbonyl-9-fluorenylidene)malononitrile, and more specifically, the 2-ethylhexanol derivative of dicyanomethylenefluorene carboxylic acid, and the like; an imaging member wherein the electron transport component is the 2-ethylhexanol derivative of a 9-dicyanomethylenefluorene-4-carboxylic acid; an imaging member wherein the photogenerating component is a metal free phthalocyanine; an imaging member wherein the photogenerating component is a metal free phthalocyanine, the electron transport is 2-ethylhexanol derivative of (4-n-butoxy carbonyl-9-fluorenylidene)malononitrile, and the charge transport is a hole transport of N,N'-diphenyl-N,N-bis(3-methyl phenyl)-1,1'-biphenyl-4,4'-diamine molecules; an imaging member wherein the X polymorph metal free phthalocyanine has major peaks, as measured with an X-ray diffractometer, at Bragg angles (2 theta+/−0.2°); an imaging member wherein the photogenerating component mixture layer further contains a second photogenerating pigment; an imaging member wherein the photogenerating mixture layer further contains a perylene; an imaging member wherein the photogenerating component is comprised of a mixture of a metal free phthalocyanine, and a second photogenerating pigment; a method of imaging which comprises generating an electrostatic latent image on the imaging member of the present invention, developing the latent image, and transferring the developed electrostatic image to a suitable substrate; a method of imaging wherein the imaging member is exposed to light of a wavelength of from about 500 to about 950 nanometers; an imaging apparatus containing a charging component, a development component, a transfer component, and a fixing component, and wherein the apparatus contains a photoconductive imaging member comprised of supporting substrate, and thereover a layer comprised of a photogenerating pigment, a charge transport component, and an electron transport component; an imaging member further containing an adhesive layer and a hole blocking layer; an imaging member wherein the blocking layer is contained as a coating on a substrate, and wherein the adhesive layer is coated on the blocking layer; and photoconductive imaging members comprised of an optional supporting substrate, a single layer comprised of a photogenerating layer of a metal free phthalocyanine, a metal phthalocyanine, a hydroxygallium phthalocyanine, vanadyl phthalocyanine, a perylene, titanyl phthalocyanine, and wherein the perylene is, for example, a BZP perylene, which BZP is preferably comprised of a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference, charge transport molecules, reference for example, U.S. Pat. No. 4,265,990, the disclosure of which is totally incorporated herein by reference, electron transport components, and a binder polymer. Preferably, the charge transport molecules for the photogenerating mixture layer are aryl amines, and the electron transport is an alkylalcohol derivative of a fluorenylidene, such as (4-n-butoxycarbonyl-9-fluorenylidene)malononitrile, reference U.S. Pat. No. 4,474,865, the disclosure of which is totally incorporated herein by reference; a photoconductive imaging member comprised in sequence of a substrate, a single electrophotographic photoconductive insulating layer, the electrophotographic photoconductive insulating layer comprising photogenerating particles comprising photogenerating pigments, such as metal free phthalocyanines, dispersed in a matrix comprising hole transport molecules such as, for example, those selected from the group consisting of arylamines and a hydrazone, and an electron transport material of, for example, alkylalkanol, such as the alkylhexanol derivatives, and more specifically $CH_2$—$CH(CH_2$—$CH_3)$—$CH_2$—$CH_2$—$CH_2$—$CH_3$, the 2-ethylhexanol derivative of BCFM, and wherein the BCFM alkylalkonal is, for example, represented by the formula

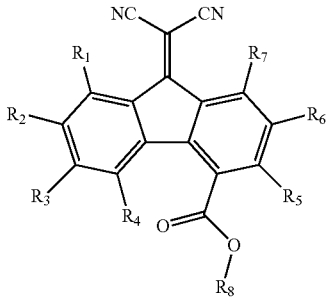

wherein each R is independently selected, for example, from the group consisting of hydrogen, halide, suitable aromatics and aliphatic substituents, such as alkyl, alkoxy, aryl, and substituted derivatives thereof, and wherein $R_8$ is an alkyl, such as an alkylhexyl like 2-ethylhexyl, and a binder, for example, selected from the group consisting of polycarbonates, polyesters, polystyrenes, and the like, and imaging members comprised of an electron transport of

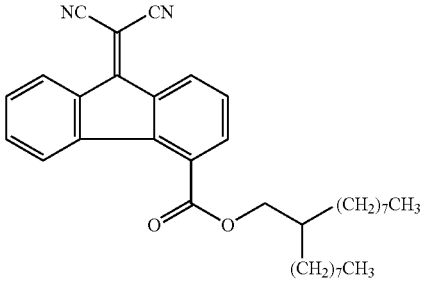

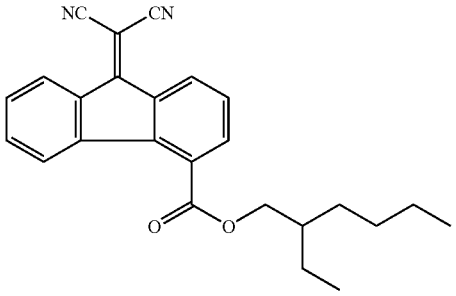

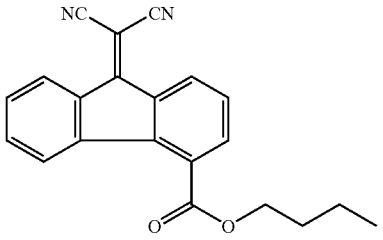

-continued

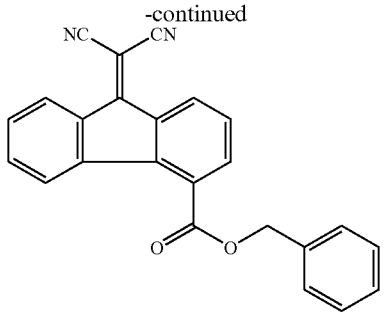

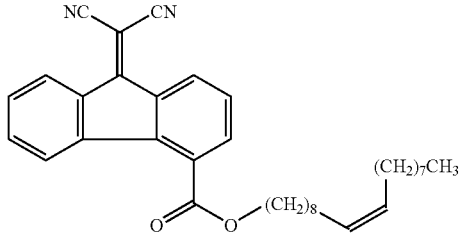

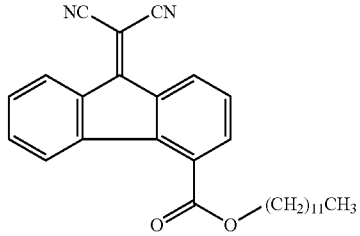

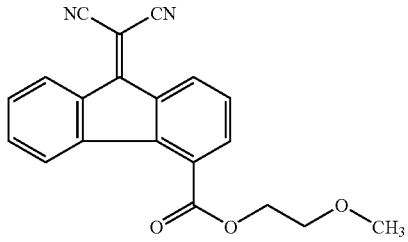

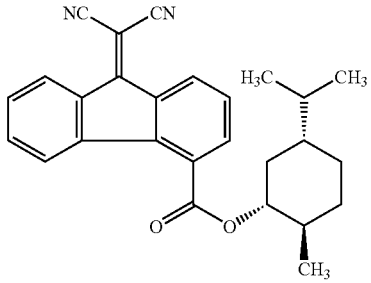

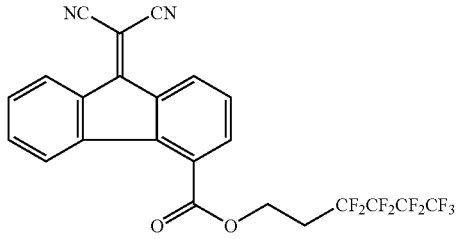

Moreover, the imaging members of the present invention can be comprised of a supporting substrate, a photogenerating layer, an electron transport layer and a charge transport layer, and wherein the electron transport layer is comprised of the BCFM derivatives of the formulas illustrated herein. Alkyl and alkoxy can possess, for example, from 1 to about 25 carbon atoms, and more specifically, from 1 to about 10 carbon atoms; aryl can possess, for example, from about 6 to about 36 carbon atoms, and more specifically, from about 6 to about 18 carbon atoms. Examples of alkyl, alkoxy, and aryl are methyl, ethyl, ethoxy, propyl, propoxy, butyl, butoxy, pentyl, pentoxy, hexyl, hexoxy, phenyl, naphthyl, and the like.

The electron transporting component can contribute to the ambipolar properties of the photoreceptor and also provide the desired rheology and substantial freedom from agglomeration of components during the preparation and application of the coating dispersion. Moreover, the electron transporting component helps ensure substantial discharge of the photoreceptor during imagewise exposure to form the electrostatic latent image.

This imaging member may be imaged by depositing a uniform electrostatic charge on the imaging member, exposing the imaging member to activating radiation in image configuration to form an electrostatic latent image, and developing the latent image with electrostatically attractable marking particles to form a toner image in conformance to the latent image.

Examples of the electron transport layer component include the alkylalcohol derivatives of CFM, and BCFM of the following formulas

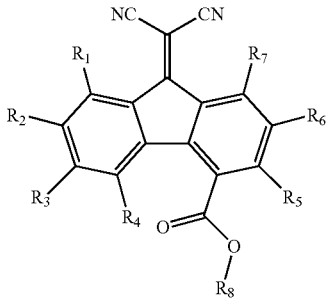

where $R_1$, $R_2$, $R_3$, $R_4$, $R_5$, $R_6$, and $R_7$ are independently selected from the group consisting of hydrogen, alkyl, alkoxy, aryl, halide, and substituted aryl; wherein $R_8$ is as illustrated herein; and which group can control the solubility of the CFM derivative. For example, where $R_8$ is n-butyl and the solvent is tetrahydrofuran the solubility of the electron transport component is 105 grams/liter whereas when $R_8$ is 2-ethylhexyl and the solvent is tetrahydrofuran the solubility is 205 grams/liter. Also, for example, where $R_8$ is n-butyl and the solvent is butylacetate the solubility is 8 grams/liter whereas when $R_8$ is 2-ethylhexyl and the solvent is butylacetate the solubility is 25 grams/liter.

A number of optional substrates, inclusive of known substrates, may be selected for the imaging member of the present invention. For example, the substrate may be opaque or substantially transparent, and may comprise any suitable material with the requisite mechanical properties. Thus, for example, the substrate may comprise a layer of insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium and the like, or exclusively be comprised of a conductive material such as aluminum, chromium, nickel, brass and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer. Examples of substrate layers selected for the imaging members of the present invention can be as indicated herein, such as an opaque or substantially transparent material, and may comprise any suitable material having the requisite mechanical properties. Thus, the substrate may comprise a layer of insulating material including inorganic or organic polymeric materials, such as MYLAR® a commercially available polymer, MYLAR® containing titanium, or other suitable metal, a layer of an organic or inorganic material having a semiconductive surface layer, such as indium tin oxide, or aluminum arranged thereon, or a conductive material inclusive of aluminum, chromium, nickel, brass or the like. The thickness of the substrate layer as indicated herein depends on many factors, including economical considerations, thus this layer may be of substantial thickness, for example over 3,000 microns, or of a minimum thickness. In one embodiment, the thickness of this layer is from about 75 microns to about 300 microns.

Generally, the thickness of the single layer in contact with the supporting substrate depends on a number of factors, including the thickness of the substrate, and the amount of components contained in the single layer, and the like. Accordingly, the layer can be of a thickness of, for example, from about 3 microns to about 60 microns, and more specifically, from about 5 microns to about 30 microns. The maximum thickness of the layer in embodiments is dependent primarily upon factors, such as photosensitivity, electrical properties and mechanical considerations.

The binder resin present in various suitable amounts, for example from about 5 to about 70, and more specifically, from about 10 to about 50 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select as coating solvents, ketones, alcohols, aromatic hydrocarbons, halogenated aliphatic hydrocarbons, ethers, amines, amides, esters, and the like. Specific binder solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

An optional adhesive layer may be formed on the substrate. Typical materials employed in an undercoat adhesive layer include, for example, polyesters, polyamides, poly (vinyl butyral), poly(vinyl alcohol), polyurethane and polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, of from about 0.001 micrometer to about 10 micrometers. A thickness of from about 0.1 micrometer to about 3 micrometers can be desirable. Optionally, the undercoat layer may contain suitable amounts of additives, for example, of from about 1 weight percent to about 10 weight percent of conductive or nonconductive particles, such as zinc oxide, titanium dioxide, silicon nitride, carbon black, and the like, to enhance, for example, electrical and optical properties. The undercoat layer can be coated on to a supporting substrate from a suitable solvent. Typical solvents include, for example, tetrahydrofuran, dichloromethane, and the like, and mixtures thereof.

The photogenerating and charge transport layers can be comprised of know components in know suitable thickness and, for example, as illustrated hereinafter.

Examples of photogenerating components, especially pigments, are as illustrated herein and other known pigments inclusive of metal free phthalocyanines, metal phthalocyanines, perylenes, vanadyl phthalocyanines, gallium phthalocyanines, hydroxygallium phthalocyanines, chloroindium phthalocyanine, and benzimidazole perylenes, which is preferably a mixture of, for example, 60/40, 50/50, 40/60, bisbenzimidazo(2,1-a-1',2'-b)anthra(2,1,9-def:6,5,10-d'e'f') diisoquinoline-6,11-dione and bisbenzimidazo(2,1-a:2',1'-a) anthra(2,1,9-def:6,5,10-d'e'f') diisoquinoline-10,21-dione, and the like, reference for example, U.S. Pat. No. 5,645,965.

Charge transport components that may be selected for the single layer mixture include, for example, arylamines, and more specifically, N,N'-diphenyl-N,N-bis(3-methyl phenyl)-1,1'-biphenyl-4,4'-diamine, 9-9-bis(2-cyanoethyl)-2,7-bis (phenyl-m-tolylamino)fluorene, tritolylamine, hydrazone, N,N'-bis(3,4 dimethylphenyl)-N"(1-biphenyl) amine and the like, dispersed in a polycarbonate binder.

The photogenerating component can be present in various amounts, such as, for example, from about 0.05 weight percent to about 30 weight percent, and more specifically, from about 0.05 weight percent to about 5 weight percent. Charge transport components, such as hole transport molecules, can be present in various effective amounts, such as in an amount of from about 10 weight percent to about 75 weight percent, and preferably in an amount of from about 30 weight percent to about 50 weight percent; the electron transport molecule can be present in various amounts, such as in an amount of from about 10 weight percent to about 75 weight percent, and more specifically, in an amount of from about 5 weight percent to about 30 weight percent, and the polymer binder can be present in an amount of from about 10 weight percent to about 75 weight percent, and more specifically, in an amount of from about 30 weight percent to about 50 weight percent. The thickness of the single photogenerating layer can be, for example, from about 5 microns to about 60 microns, and more specifically, from about 10 microns to about 30 microns.

The photogenerating pigment primarily functions to absorb the incident radiation and generates electrons and holes. In a negatively charged imaging member, holes are transported to the photoconductive surface to neutralize negative charge and electrons are transported to the substrate to permit photodischarge. In a positively charged imaging member, electrons are transported to the surface where they neutralize the positive charges and holes are transported to the substrate to enable photodischarge. By selecting the appropriate amounts of charge and electron transport molecules, ambipolar transport can be obtained, that is, the imaging member can be charged negatively or positively, and the member can also be photodischarged.

The photoconductive imaging members can be prepared by a number of methods, such as the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating, electron transport, and charge transport components of the imaging members can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of from about 5 to about 40 microns after drying.

Imaging members of the present invention are useful in various electrostatographic imaging and printing systems, particularly those conventionally known as xerographic processes. Specifically, the imaging members of the present invention are useful in xerographic imaging processes wherein the photogenerating component absorbs light of a wavelength of from about 550 to about 950 nanometers, and preferably from about 700 to about 850 nanometers. Moreover, the imaging members of the present invention can be selected for electronic printing processes with gallium arsenide diode lasers, light emitting diode (LED) arrays which typically function at wavelengths of from about 660 to about 830 nanometers, and for color systems inclusive of color printers, such as those in communication with a computer. Thus, included within the scope of the present invention are methods of imaging and printing with the photoresponsive or photoconductive members illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing, for example, by heat the image thereto. In those environments wherein the member is to be used in a printing mode, the imaging method is similar with the exception that the exposure step can be accomplished with a laser device or image bar.

Polymer binder examples include components, as illustrated, for example, in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins with a molecular weight of from about 20,000 to about 100,000, and more specifically, with a molecular weight $M_w$ of from about 50,000 to about 100,000.

The combined weight of the arylamine hole transport molecules and the electron transport molecules is, for example, from about 30 percent to about 65 percent by weight, based on the total weight of the mixture after drying. The polymer binder can be present in an amount of from about 10 weight percent to about 75 weight percent, and preferably in an amount of from about 30 weight percent to about 60 weight percent, based on the total weight of the mixture after drying. The hole transport and electron transport molecules are dissolved or molecularly dispersed in the film forming binder. The expression "molecularly dispersed" refers to, for example, as dispersed on a molecular scale. The above materials can be processed into a dispersion useful for coating by any of the conventional methods used to prepare such materials. These methods include ball milling, media milling in both vertical or horizontal bead mills, paint shaking the materials with suitable grinding media, and the like to achieve a suitable dispersion.

The following Examples are provided.

The XRPDs were determined as indicated herein, that is X-ray powder diffraction traces (XRPDs) were generated on a Philips X-Ray Powder Diffractometer Model 1710 using X-radiation of CuK-alpha wavelength (0.1542 nanometer).

EXAMPLE I

Preparation of Fluorenone-4-carboxylic Acid

Diphenic acid (850 grams) was added slowly to concentrated sulfuric acid (4,250 grams) and stirred until dissolved. The resulting solution was stirred and heated at 70° C. for 6.5 hours and then cooled to room temperature, about 22° C. to 25° C. (degrees Centigrade throughout). The solution was precipitated into water with gentle stirring (vigorous stirring may provide a solid which is difficult to filter). The resulting precipitate was filtered and the cake obtained was washed with distilled-dionized water until the washings were at a pH of 7. There resulted as a free flowing powder the above product after freeze drying. Yield was 780 grams. The identity and purity, greater than about 98 percent, for example 98.9 percent, of the compound was determined using $^1$H NMR (DMSO-d6).

EXAMPLE II

Preparation of 9-Dicyanomethylenefluorene-4-(2-ethylhexyl)carboxylate

Fluorenone-4-carboxylic acid (780 grams), toluene (5 liters), 2-ethylhexanol (1 liter) and paratoluene sulfonic acid (20 grams) was added to a 12 liter rounded-bottomed flask fitted with argon inlet, mechanical stirring and Dean-Stark trap. The mixture was heated at reflux until evolution of water stopped. The toluene was removed and to the residual material, used without further purification, was added methanol (9.8 liter), malononitrile (460 grams) and piperidine (25 milliliters). The resulting solution was stirred at room temperature until HPLC (RP-18, mobile phase 1 milliliter/minute acetonitrile:0.2 milliliter/minute methanol, UV detection) indicated complete reaction. The product formed as an insoluble solid and could easily be filtered and washed with methanol until the washings are colorless. Crude yield was 1.1 kilograms. Purification could be accomplished either by sublimation or chemical means, and wherein the purity was greater than about 99 percent, and more specifically, 99.7 percent.

EXAMPLE III

Chemical Purification of 9-Dicyanomethylenefluorene-4-(2-ethylhexyl)carboxylate 9-Dicyanomethylenefluorene-4-(2-ethylhexyl)carboxylate (200 grams) and 1-butanol (820 grams) were heated to about 95° C. to about 96° C. for 30 minutes. Insoluble materials were hot filtered with a 11 centimeter Buchner with #30 glass fiber filter paper. The filtrate was allowed to cool to room temperature slowly with stirring. The resulting precipitate was isolated by filtration and the cake obtained was washed with 1-butanol until the brown color of filtrate converted to yellow. The solid was slurried at room temperature in 1 liter of methanol for 30 minutes, filtered and rinsed with 3×150 milliliter portions of methanol, and finally dried at 30° C./5 millimeters Hg overnight. Yield was 169.9 grams.

EXAMPLE IV

A pigment dispersion was prepared by roll milling 2.15 grams of Type V hydroxygallium phthalocyanine pigment particles and 2.15 grams of poly(4,4'-diphenyl-1,1'-cyclohexane carbonate) (PCZ400, available from Mitsubishi Gas Chemical Company, Inc.) binder in 26.5 grams of tetrahydrofuran (THF) and 6.6 grams of monochlorobenzene with 280 grams of 3 millimeter diameter steel balls for about 25 to about 30 hours.

Separately, 1.86 grams of poly(4,4'-diphenyl-1,1'-cyclohexane carbonate) were weighed along with 1.22 grams of N,N'-diphenyl-N,N'-bis(methylphenyl)-1,1-biphenyl-4,4'-diamine, 0.81 gram of the above prepared 2-ethylhexanol derivative of CFM (EHCFM), 8.76 grams of tetrahydrofuran (THF) and 2.19 grams of monochlorobenzene. This mixture was rolled in a glass bottle until the solids were dissolved, then 1.75 grams of the above pigment dispersion were added to form a dispersion containing Type V hydroxy gallium phthalocyanine, poly(4,4'-diphenyl-1,1'-cyclohexane carbonate), N,N'-diphenyl-N,N'-bis(methylphenyl)-1,1-biphenyl-4,4'-diamine, 2-ethylhexanol derivative of CFM (EHCFM) in a solids weight ratio of (2.5:47.5:30:20) and a total solid contents of 25 percent; and rolled to mix (without milling beads). Various dispersions were prepared at total solids contents ranging from about 25 percent to about 28.5 percent. The dispersions were applied with a 6 mil film coating applicator to an aluminized MYLAR® (polyethylene terephthalate) and dried at 115° C. for 60 minutes to result in a thickness for the layer of about 19 microns. The 18.8 micron thickness of the resulting dried layers was determined by capacitive measurements and a thickness gauge; thickness was usually between about 10 and about 30 microns, and more specifically, between about 15 to about 25 microns.

EXAMPLE V

The xerographic electrical properties of the above prepared photoconductive imaging member and other similar members can be determined by known means, including electrostatically charging the surfaces thereof with a corona discharge source until the surface potentials, as measured by a capacitively coupled probe attached to an electrometer, attained an initial value $V_o$ of about +600 volts. After resting for 0.5 second in the dark, the charged members attained a surface potential of $V_{ddp}$, dark development potential. Each member was then exposed to light from a filtered Xenon lamp thereby inducing a photodischarge which resulted in a reduction of surface potential to a $V_{bg}$ value, background potential. The percent of photodischarge was calculated as $100\times(V_{ddp}-V_{bg})V_{ddp}$. The desired wavelength and energy of the exposed light were determined by the type of filters placed in front of the lamp. The monochromatic light photosensitivity was determined using a narrow band-pass filter. The photosensitivity of the imaging member was usually provided in terms of the amount of exposure energy in ergs/cm$^2$, designated as $E_{1/2}$, required to achieve 50 percent photodischarge from $V_{ddp}$ to half of its initial value. The higher the photosensitivity, the smaller was the $E_{1/2}$ value. The $E_{7/8}$ value corresponded to the exposure energy required to achieve 7/8 photodischarge from $V_{ddp}$. The device was finally exposed to an erase lamp of appropriate light intensity and any residual potential ($V_{residual}$) was measured. The imaging members were tested with a monochromatic light exposure at a wavelength of 780+/−10 nanometers and an erase light with the wavelength of about 600 to about 800 nanometers and intensity of 175 ergs.cm$^2$. Photoinduced discharge characteristic (PIDC) curves in positive charging mode of a 18.8 micrometer thick device of Example I exhibited an $E_{1/2}$ of 1.8 ergs/cm$^2$, an $E_{7/8}$ of 5.9 ergs/cm$^2$ and a residual potential of approximately +16 volts.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A photoconductive imaging member comprised of a supporting substrate, and thereover a single layer comprised of a mixture of a photogenerator component, a charge transport component, an electron transport component, and a polymer binder, and wherein the electron component is comprised of

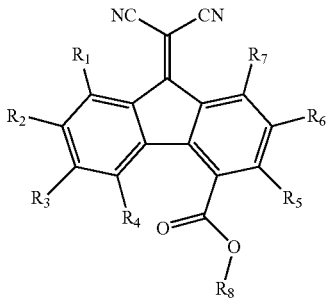

wherein $R_1$ to $R_7$ are independently selected from the group consisting of hydrogen, halide, alkyl, alkoxy, and aryl, and wherein $R_8$ is an alkyl alkyl.

2. A photoconductive imaging member comprised of a supporting substrate, and thereover a single layer comprised of a mixture of photogenerator component, a charge transport component, an electron transport component, and a binder, and wherein the electron component is comprised of an alkylalcohol derivative of the formula

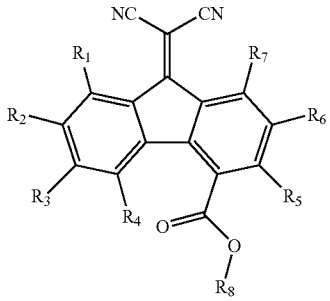

wherein $R_1$ to $R_7$ are independently selected from the group consisting of hydrogen, halide, alkyl, alkoxy, and aryl, and wherein $R_8$ is an alkyl alkyl.

3. An imaging member in accordance with claim 2 wherein said derivative is the 2-ethylhexanol derivative of CFM of the formula.

4. An imaging member in accordance with claim 1 wherein said single layer is of a thickness of from about 5 to about 60 microns.

5. An imaging member in accordance with claim 1 wherein the amounts for each of said components in said single layer is from about 0.05 weight percent to about 30 weight percent for the photogenerating component, from about 10 weight percent to about 75 weight percent for the charge transport component, and from about 10 weight percent to about 75 weight percent for the electron transport component, and wherein the total of said components is about 100 percent, and wherein said layer components are dispersed in from about 10 weight percent to about 75 weight percent of said polymer binder, and wherein said single layer is of a thickness of from about 5 to about 15 microns.

6. An imaging member in accordance with claim 1 wherein the amounts for each of said components in the single layer mixture is from about 0.5 weight percent to about 5 weight percent for the photogenerating component; from about 30 weight percent to about 50 weight percent for the charge transport component; and from about 5 weight percent to about 30 weight percent for the electron transport component; and which components are contained in from about 30 weight percent to about 50 weight percent of said polymer binder.

7. An imaging member in accordance with claim 1 wherein the thickness of said single layer is from about 5 to about 35 microns, wherein said single layer components are dispersed in said polymer binder, and wherein said charge transport is comprised of hole transport molecules, and wherein said binder is present in an amount of from about 50 to about 90 percent by weight, and wherein the total of all components of said photogenerating component, said charge transport component, said binder, and said electron transport component is about 100 percent.

8. An imaging member in accordance with claim 1 wherein said photogenerating component absorbs light of a wavelength of from about 370 to about 950 nanometers.

9. An imaging member in accordance with claim 1 wherein the supporting substrate is comprised of a conductive substrate comprised of a metal.

10. An imaging member in accordance with claim 9 wherein the conductive substrate is aluminum, aluminized polyethylene terephthalate or titanized polyethylene terephthalate.

11. An imaging member in accordance with claim 1 wherein the polymer binder is selected from the group consisting of polyesters, polyvinyl butyrals, polycarbonates, polystyrene-b-polyvinyl pyridine, and polyvinyl formulas.

12. An imaging member in accordance with claim 1 wherein said charge transporting component or components is comprised of molecules of the formula

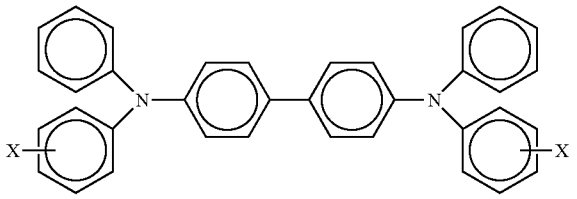

wherein X is selected from the group consisting of alkyl, alkoxy and halogen.

13. An imaging member in accordance with claim 12 wherein alkyl contains from about 1 to about 10 carbon atoms, and wherein the charge transport is an aryl amine encompassed by said formula, and which amine is optionally dispersed in a resinous binder.

14. An imaging member in accordance with claim 12 wherein alkyl is methyl, and wherein halogen is chloride.

15. An imaging member in accordance with claim 12 wherein said charge transport is comprised of molecules of N,N'-diphenyl-N,N-bis(3-methyl phenyl)-1,1'-biphenyl-4,4'-diamine.

16. An imaging member in accordance with claim 1 wherein said alkyl and said alkoxy of said electron transport component contains from 1 to about 25 carbon atoms, and said aryl contains from about 6 to about 30 carbon atoms.

17. An imaging member in accordance with claim 2 wherein said alcohol of said electron transport component contains from 1 to about 10 carbon atoms and at least one hydroxy group.

18. An imaging member in accordance with claim 2 wherein said alcohol is methanol, ethanol, propylanol, butylanol, or hexanol, and said alkyl is methyl, ethyl, propyl, or butyl.

19. An imaging member in accordance with claim 2 wherein said alkyl is ethyl and said alcohol is hexanol.

20. An imaging member in accordance with claim 1 wherein said photogenerating component is a pigment of a metal free or a metal phthalocyanine.

21. An imaging member in accordance with claim 1 wherein said photogenerating component is a hydroxygallium phthalocyanine.

22. An imaging member in accordance with claim 1 wherein said photogenerating component is a perylene or a titanyl phthalocyanine.

23. A method of imaging which comprises generating an image on the imaging member of claim 1, developing the latent image, and optionally transferring the image to a suitable substrate.

24. An imaging member in accordance with claim 1 further containing an adhesive layer and a hole blocking layer.

25. An imaging member in accordance with claim 24 wherein said blocking layer is contained as a coating on a substrate, and wherein said adhesive layer is coated on said blocking layer.

26. An imaging member in accordance with claim 12 wherein said arylamine is N,N'-diphenyl-N,N'-bis(3-methylphenyl)-[1,1-biphenyl]-4,4'-diamine.

27. An imaging member in accordance with claim 12 further containing a binder of a polycarbonate, and wherein said single layer is of a thickness of from about 4 micrometers to about 50 micrometers after dying.

28. An imaging member in accordance with claim 1 wherein said single layer components are dispersed in a binder selected from the group consisting of polycarbonates and a polystyrene-b-polyvinyl pyridine, and wherein the charge transport comprises hole transport components of a N,N'-diphenyl-N,N'-bis(alkylphenyl)-1,1-biphenyl-4,4'-diamine; TTA, tri-p-tolylamine; AE-18, N,N'-bis-(3,4,-dimethylphenyl)-4-biphenyl amine; and AB-16, N,N'-bis-(4-methylphenyl)-N,N"-bis(4-ethylphenyl)-1,1'-3,3'-dimethylbiphenyl)-4,4'-diamine.

29. A photoconductive imaging member comprised of a photogenerating layer, an electron transport layer and a charge transport layer, and wherein the electron component is of the formula

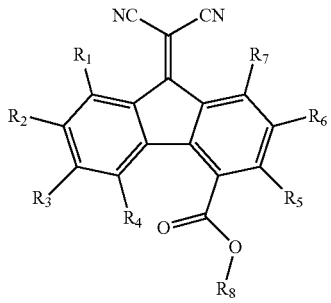

and wherein said charge transport layer is comprised of molecules of the formula

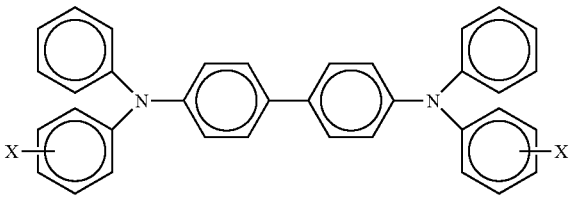

wherein X is selected from the group consisting of alkyl, alkoxy and halogen.

30. An imaging member in accordance with claim 1 wherein said alkyl alkyl for $R_8$ contains from about 2 to about 26 carbon atoms.

31. An imaging member in accordance with claim 1 wherein said alkyl alkyl is an alkyl hexyl.

32. An imaging member in accordance with claim 1 wherein said electron transport is 9-dicyanomethylene fluorene-4-(2-ethylhexyl) carboxylate, or 4-(2-ethyl-1-hexoxycarbonyl-9-fluorenylidene)malononitrile (2EHCFM).

33. An imaging member in accordance with claim 1 wherein said alkyl is methyl, ethyl, propyl, butyl, pentyl, hexyl, octyl, nonyl, or the isomers and derivatives thereof; said aryl contains from about 6 to about 18 carbon atoms; and said $R_8$ alkyl alkyl contains from about 2 to about 15 carbon atoms.

34. An imaging member comprised of a single layer comprised of a mixture of a photogenerating component, an arylamine charge transport component, an electron transport component, and a polymeric binder, and wherein said electron transport is of the formula containing an electron transport of the formula

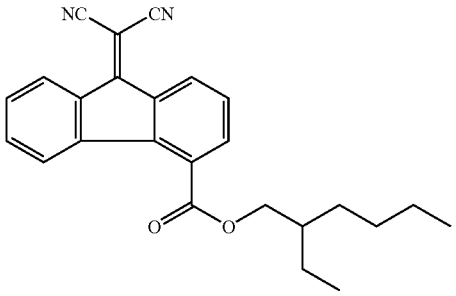

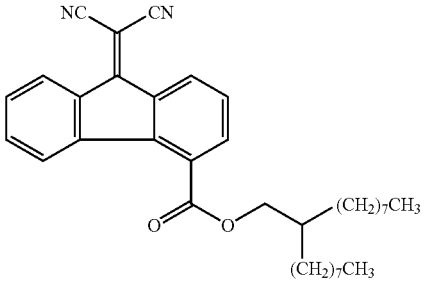

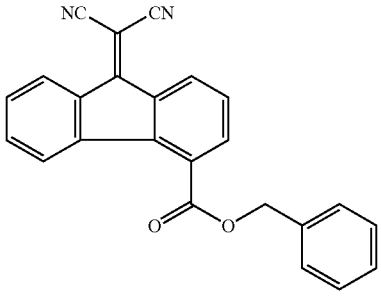

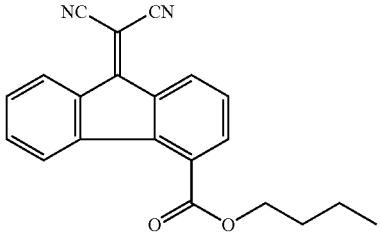

-continued

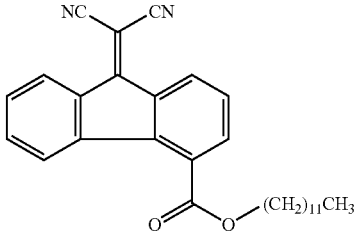

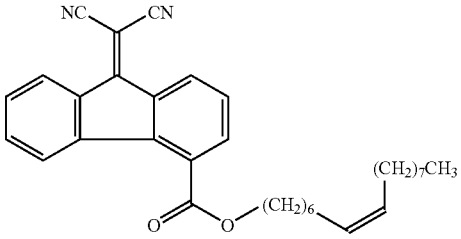

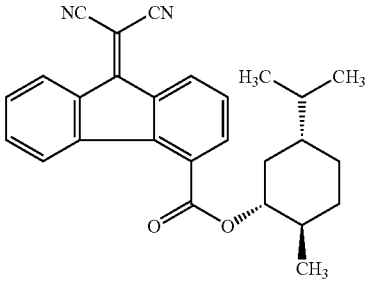

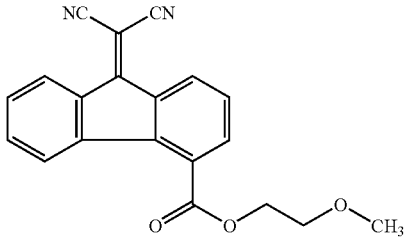

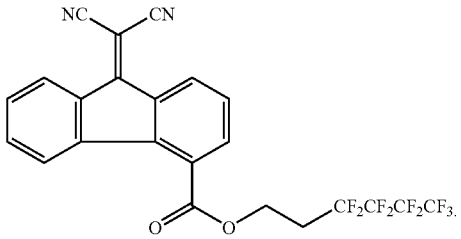

* * * * *